US008403444B2

(12) United States Patent
Chikuma et al.

(10) Patent No.: US 8,403,444 B2
(45) Date of Patent: Mar. 26, 2013

(54) RECORDING APPARATUS AND METHOD FOR ADJUSTING RECORDING POSITION

(75) Inventors: Toshiyuki Chikuma, Tokyo (JP); Kiichiro Takahashi, Yokohama (JP); Tetsuya Edamura, Kawasaki (JP); Hirokazu Tanaka, Kawasaki (JP); Takatoshi Nakano, Tokyo (JP); Wakako Yamamoto, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 12/794,620

(22) Filed: Jun. 4, 2010

(65) Prior Publication Data

US 2010/0309242 A1 Dec. 9, 2010

(30) Foreign Application Priority Data

Jun. 8, 2009 (JP) ..... 2009-137340

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS

| | | | | |
|---|---|---|---|---|
| 2003/0085943 | A1* | 5/2003 | Nakamura et al. | 347/19 |
| 2004/0090475 | A1* | 5/2004 | Ioka et al. | 347/5 |
| 2005/0099439 | A1* | 5/2005 | Folkins | 347/8 |
| 2006/0114282 | A1* | 6/2006 | Mizes et al. | 347/19 |
| 2007/0013732 | A1* | 1/2007 | Sakamoto et al. | 347/20 |

FOREIGN PATENT DOCUMENTS

| | | | |
|---|---|---|---|
| JP | 2002-103576 | A | 4/2002 |
| JP | 2004-106522 | A | 4/2004 |
| JP | 2004-136555 | A | 5/2004 |
| JP | 2004-136555 | A | 5/2004 |
| JP | 2005-081570 | A | 3/2005 |
| JP | 2005-096368 | A | 4/2005 |
| JP | 2005-096371 | A | 4/2005 |
| JP | 2006-007616 | A | 1/2006 |
| JP | 2007-038649 | A | 2/2007 |

* cited by examiner

*Primary Examiner* — Laura Martin
(74) *Attorney, Agent, or Firm* — Canon U.S.A., Inc. IP Division

(57) ABSTRACT

According to the present invention, a recording apparatus is provided which is capable of recording a plurality of patterns, on a recording medium, for detecting an amount of displacement between a recording position of a first discharge port array and a recording position of a second discharge port array in a conveyance direction and acquiring an amount of inclination based on the amount of displacement without conveying the recording medium.

13 Claims, 15 Drawing Sheets

| | COEFFICIENT | | | AMOUNT OF DISPLACEMENT |
|---|---|---|---|---|
| | a | b | c | |
| M0 | 16 | 0 | 0 | -21.2 |
| M1 | 15 | 1 | 0 | -19.8 |
| M2 | 14 | 2 | 0 | -18.5 |
| M3 | 13 | 3 | 0 | -17.2 |
| M4 | 12 | 4 | 0 | -15.9 |
| M5 | 11 | 5 | 0 | -14.6 |
| M6 | 10 | 6 | 0 | -13.2 |
| M7 | 9 | 7 | 0 | -11.9 |
| M8 | 8 | 8 | 0 | -10.6 |
| M9 | 7 | 9 | 0 | -9.3 |
| M10 | 6 | 10 | 0 | -7.9 |
| M11 | 5 | 11 | 0 | -6.6 |
| M12 | 4 | 12 | 0 | -5.3 |
| M13 | 3 | 13 | 0 | -4 |
| M14 | 2 | 14 | 0 | -2.6 |
| M15 | 1 | 15 | 0 | -1.3 |
| M16 | 0 | 16 | 0 | 0 |
| M17 | 0 | 15 | 1 | 1.3 |
| M18 | 0 | 14 | 2 | 2.6 |
| M19 | 0 | 13 | 3 | 4 |
| M20 | 0 | 12 | 4 | 5.3 |
| M21 | 0 | 11 | 5 | 6.6 |
| M22 | 0 | 10 | 6 | 7.9 |
| M23 | 0 | 9 | 7 | 9.3 |
| M24 | 0 | 8 | 8 | 10.6 |
| M25 | 0 | 7 | 9 | 11.9 |
| M26 | 0 | 6 | 10 | 13.2 |
| M27 | 0 | 5 | 11 | 14.6 |
| M28 | 0 | 4 | 12 | 15.9 |
| M29 | 0 | 3 | 13 | 17.2 |
| M30 | 0 | 2 | 14 | 18.5 |
| M31 | 0 | 1 | 15 | 19.8 |
| M32 | 0 | 0 | 16 | 21.2 |

FIG.13

| GROUP NUMBER | BLOCK NUMBER | NOZZLE NUMBER |
|---|---|---|
| 0 | 0 | NOZZLE 0 |
| | 1 | NOZZLE 1 |
| | 2 | NOZZLE 2 |
| | 3 | NOZZLE 3 |
| | 4 | NOZZLE 4 |
| | 5 | NOZZLE 5 |
| | 6 | NOZZLE 6 |
| | 7 | NOZZLE 7 |
| | 8 | NOZZLE 8 |
| | 9 | NOZZLE 9 |
| | 10 | NOZZLE 10 |
| | 11 | NOZZLE 11 |
| | 12 | NOZZLE 12 |
| | 13 | NOZZLE 13 |
| | 14 | NOZZLE 14 |
| | 15 | NOZZLE 15 |
| 1 | 0 | NOZZLE 16 |
| | 1 | NOZZLE 17 |
| | 2 | NOZZLE 18 |
| | 3 | NOZZLE 19 |
| | 4 | NOZZLE 20 |
| | 5 | NOZZLE 21 |
| | 6 | NOZZLE 22 |
| | 7 | NOZZLE 23 |
| | 8 | NOZZLE 24 |
| | 9 | NOZZLE 25 |
| | 10 | NOZZLE 26 |
| | 11 | NOZZLE 27 |
| | 12 | NOZZLE 28 |
| | 13 | NOZZLE 29 |
| | 14 | NOZZLE 30 |
| | 15 | NOZZLE 31 |
| ⋮ | | |
| 14 | 0 | NOZZLE 224 |
| | 1 | NOZZLE 225 |
| | 2 | NOZZLE 226 |
| | 3 | NOZZLE 227 |
| | 4 | NOZZLE 228 |
| | 5 | NOZZLE 229 |
| | 6 | NOZZLE 230 |
| | 7 | NOZZLE 231 |
| | 8 | NOZZLE 232 |
| | 9 | NOZZLE 233 |
| | 10 | NOZZLE 234 |
| | 11 | NOZZLE 235 |
| | 12 | NOZZLE 236 |
| | 13 | NOZZLE 237 |
| | 14 | NOZZLE 238 |
| | 15 | NOZZLE 239 |
| 15 | 0 | NOZZLE 240 |
| | 1 | NOZZLE 241 |
| | 2 | NOZZLE 422 |
| | 3 | NOZZLE 243 |
| | 4 | NOZZLE 244 |
| | 5 | NOZZLE 245 |
| | 6 | NOZZLE 246 |
| | 7 | NOZZLE 247 |
| | 8 | NOZZLE 248 |
| | 9 | NOZZLE 249 |
| | 10 | NOZZLE 250 |
| | 11 | NOZZLE 251 |
| | 12 | NOZZLE 252 |
| | 13 | NOZZLE 253 |
| | 14 | NOZZLE 254 |
| | 15 | NOZZLE 255 |

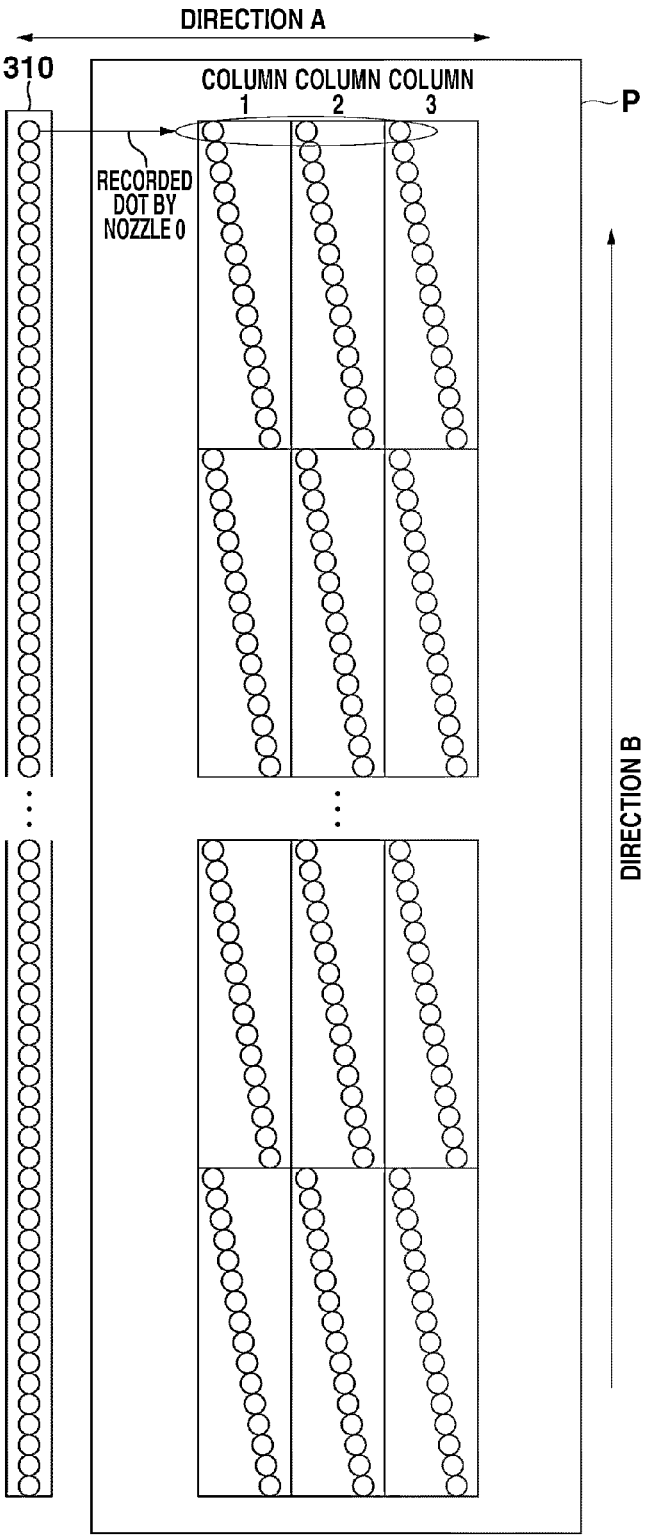

FIG.14

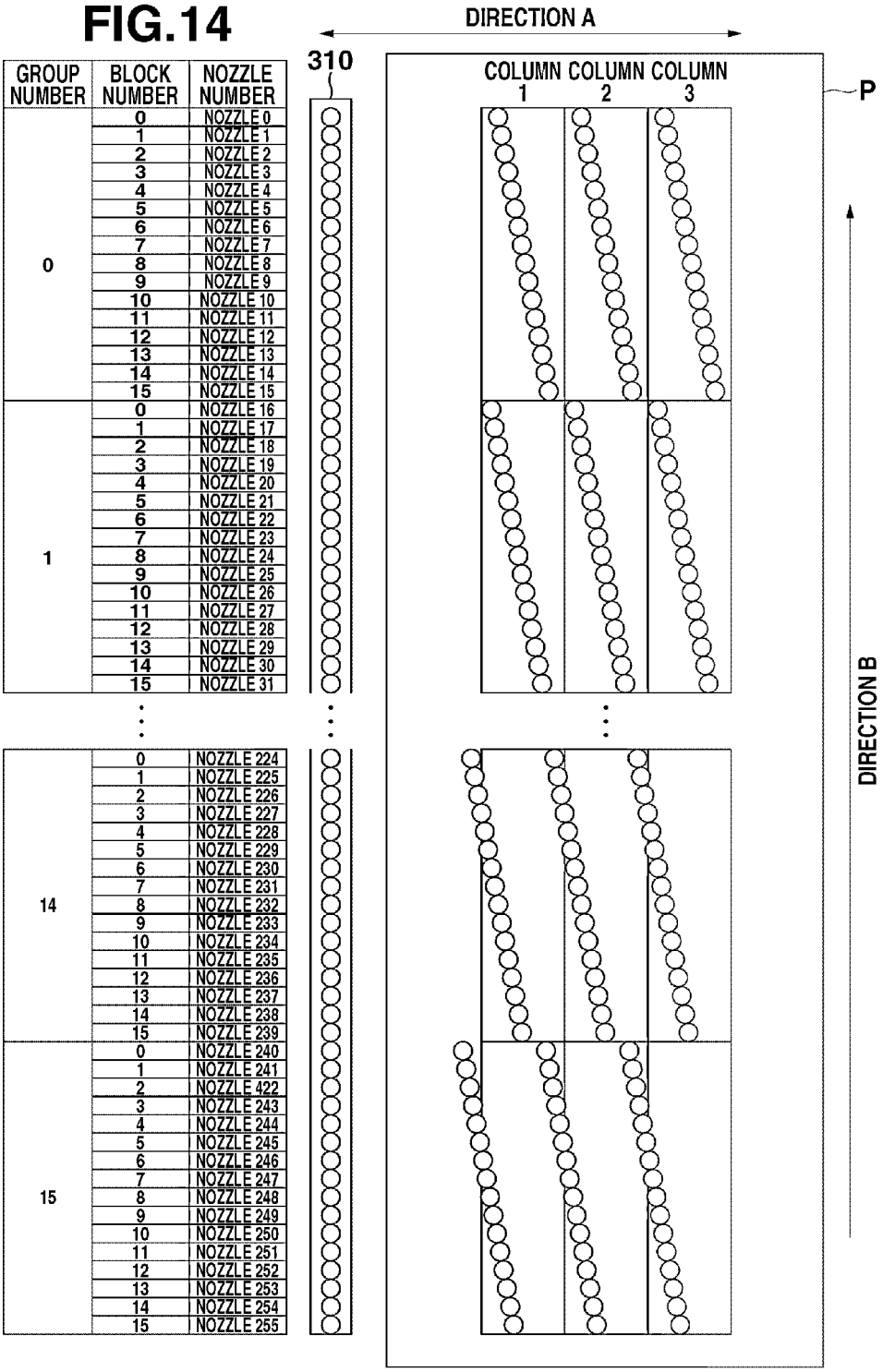

| GROUP NUMBER | BLOCK NUMBER | NOZZLE NUMBER |
|---|---|---|
| 0 | 0 | NOZZLE 0 |
| | 1 | NOZZLE 1 |
| | 2 | NOZZLE 2 |
| | 3 | NOZZLE 3 |
| | 4 | NOZZLE 4 |
| | 5 | NOZZLE 5 |
| | 6 | NOZZLE 6 |
| | 7 | NOZZLE 7 |
| | 8 | NOZZLE 8 |
| | 9 | NOZZLE 9 |
| | 10 | NOZZLE 10 |
| | 11 | NOZZLE 11 |
| | 12 | NOZZLE 12 |
| | 13 | NOZZLE 13 |
| | 14 | NOZZLE 14 |
| | 15 | NOZZLE 15 |
| 1 | 0 | NOZZLE 16 |
| | 1 | NOZZLE 17 |
| | 2 | NOZZLE 18 |
| | 3 | NOZZLE 19 |
| | 4 | NOZZLE 20 |
| | 5 | NOZZLE 21 |
| | 6 | NOZZLE 22 |
| | 7 | NOZZLE 23 |
| | 8 | NOZZLE 24 |
| | 9 | NOZZLE 25 |
| | 10 | NOZZLE 26 |
| | 11 | NOZZLE 27 |
| | 12 | NOZZLE 28 |
| | 13 | NOZZLE 29 |
| | 14 | NOZZLE 30 |
| | 15 | NOZZLE 31 |
| ⋮ | | |
| 14 | 0 | NOZZLE 224 |
| | 1 | NOZZLE 225 |
| | 2 | NOZZLE 226 |
| | 3 | NOZZLE 227 |
| | 4 | NOZZLE 228 |
| | 5 | NOZZLE 229 |
| | 6 | NOZZLE 230 |
| | 7 | NOZZLE 231 |
| | 8 | NOZZLE 232 |
| | 9 | NOZZLE 233 |
| | 10 | NOZZLE 234 |
| | 11 | NOZZLE 235 |
| | 12 | NOZZLE 236 |
| | 13 | NOZZLE 237 |
| | 14 | NOZZLE 238 |
| | 15 | NOZZLE 239 |
| 15 | 0 | NOZZLE 240 |
| | 1 | NOZZLE 241 |
| | 2 | NOZZLE 422 |
| | 3 | NOZZLE 243 |
| | 4 | NOZZLE 244 |
| | 5 | NOZZLE 245 |
| | 6 | NOZZLE 246 |
| | 7 | NOZZLE 247 |
| | 8 | NOZZLE 248 |
| | 9 | NOZZLE 249 |
| | 10 | NOZZLE 250 |
| | 11 | NOZZLE 251 |
| | 12 | NOZZLE 252 |
| | 13 | NOZZLE 253 |
| | 14 | NOZZLE 254 |
| | 15 | NOZZLE 255 |

FIG.15

| GROUP NUMBER | BLOCK NUMBER | NOZZLE NUMBER |
|---|---|---|
| 0 | 0 | NOZZLE 0 |
| | 1 | NOZZLE 1 |
| | 2 | NOZZLE 2 |
| | 3 | NOZZLE 3 |
| | 4 | NOZZLE 4 |
| | 5 | NOZZLE 5 |
| | 6 | NOZZLE 6 |
| | 7 | NOZZLE 7 |
| | 8 | NOZZLE 8 |
| | 9 | NOZZLE 9 |
| | 10 | NOZZLE 10 |
| | 11 | NOZZLE 11 |
| | 12 | NOZZLE 12 |
| | 13 | NOZZLE 13 |
| | 14 | NOZZLE 14 |
| | 15 | NOZZLE 15 |
| 1 | 0 | NOZZLE 16 |
| | 1 | NOZZLE 17 |
| | 2 | NOZZLE 18 |
| | 3 | NOZZLE 19 |
| | 4 | NOZZLE 20 |
| | 5 | NOZZLE 21 |
| | 6 | NOZZLE 22 |
| | 7 | NOZZLE 23 |
| | 8 | NOZZLE 24 |
| | 9 | NOZZLE 25 |
| | 10 | NOZZLE 26 |
| | 11 | NOZZLE 27 |
| | 12 | NOZZLE 28 |
| | 13 | NOZZLE 29 |
| | 14 | NOZZLE 30 |
| | 15 | NOZZLE 31 |
| ⋮ | | |
| 14 | 0 | NOZZLE 224 |
| | 1 | NOZZLE 225 |
| | 2 | NOZZLE 226 |
| | 3 | NOZZLE 227 |
| | 4 | NOZZLE 228 |
| | 5 | NOZZLE 229 |
| | 6 | NOZZLE 230 |
| | 7 | NOZZLE 231 |
| | 8 | NOZZLE 232 |
| | 9 | NOZZLE 233 |
| | 10 | NOZZLE 234 |
| | 11 | NOZZLE 235 |
| | 12 | NOZZLE 236 |
| | 13 | NOZZLE 237 |
| | 14 | NOZZLE 238 |
| | 15 | NOZZLE 239 |
| 15 | 0 | NOZZLE 240 |
| | 1 | NOZZLE 241 |
| | 2 | NOZZLE 422 |
| | 3 | NOZZLE 243 |
| | 4 | NOZZLE 244 |
| | 5 | NOZZLE 245 |
| | 6 | NOZZLE 246 |
| | 7 | NOZZLE 247 |
| | 8 | NOZZLE 248 |
| | 9 | NOZZLE 249 |
| | 10 | NOZZLE 250 |
| | 11 | NOZZLE 251 |
| | 12 | NOZZLE 252 |
| | 13 | NOZZLE 253 |
| | 14 | NOZZLE 254 |
| | 15 | NOZZLE 255 |

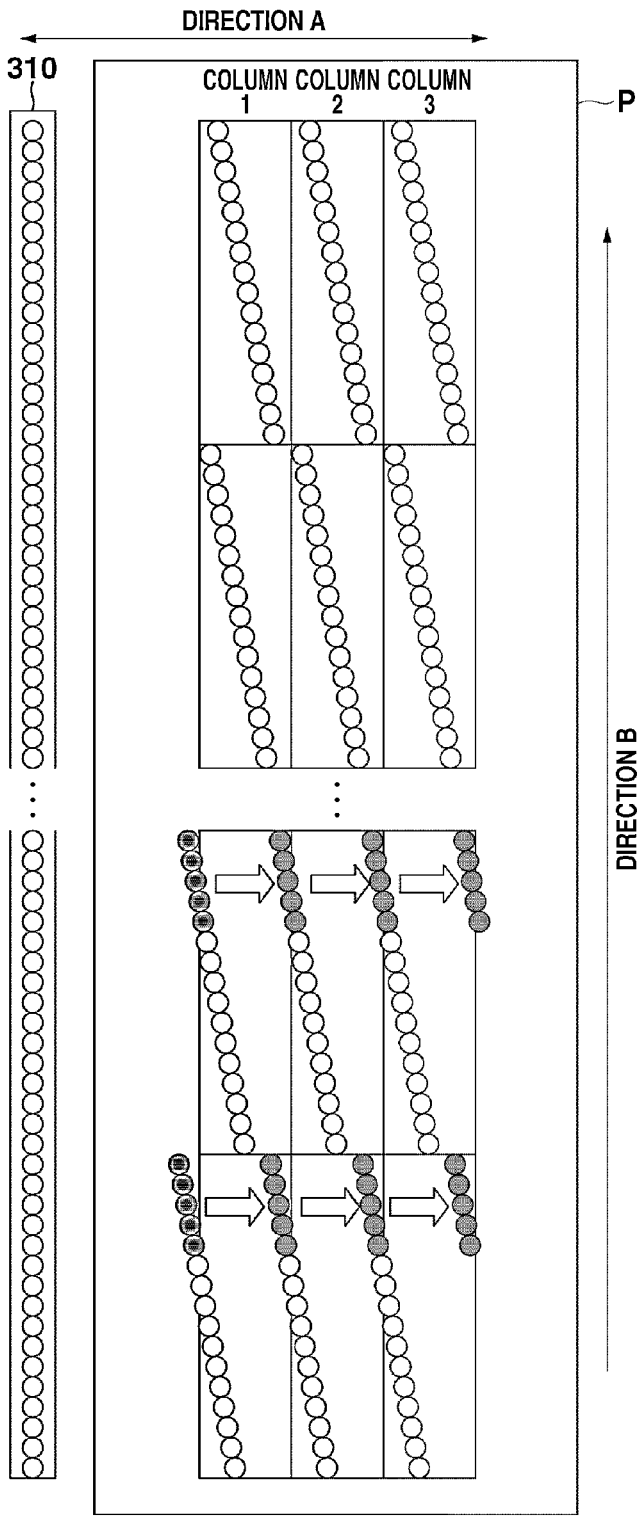

RECORDING APPARATUS AND METHOD FOR ADJUSTING RECORDING POSITION

BACKGROUND OF THE INVENTION

1. Field of the Invention

The present invention relates to a recording apparatus which discharges ink from a recording head to record an image and a method for adjusting a recording position in the recording apparatus.

2. Description of the Related Art

In an inkjet recording apparatus, a position (recording position) of a dot which is recorded by the same discharge port array of a recording head may be inclined to a moving direction of the recording head caused by an attachment error of the recording head or the like. Japanese Patent Application Laid-Open No. 2007-038649 discusses recording a test pattern for detecting the extent of an inclination in a recording position (also, referred to as an amount of inclination) on a recording medium in order to correct the inclination of dots to be recorded by the same discharge port array.

However, in a technique discussed in Japanese Patent Application Laid-Open No. 2007-038649, when the test pattern for detecting the amount of inclination is recorded, the recording medium is to be conveyed. Thus, there may be a situation that a conveyance error, when the recording medium is conveyed, affects the recording position of dots in the test pattern and the amount of inclination cannot accurately be detected.

SUMMARY OF THE INVENTION

According to an aspect of the present invention, an apparatus causes a recording head, including a first discharge port array and a second discharge port array in which a plurality of discharge ports for discharging ink is arranged to move in a moving direction and a conveyance unit to convey a recording medium in a conveyance direction different from the moving direction, to record an image on the recording medium. The apparatus includes a controller configured to cause the first and second discharge port arrays to record a plurality of patterns on the recording medium for acquiring an amount of displacement between a first recording position of the first discharge port array and a second recording position of the second discharge port array in the conveyance direction, an acquisition unit configured to acquire an amount of inclination of the first recording position to the moving direction based on the amount of displacement between the first recording position and the second recording position in the conveyance direction, and a correction unit configured to correct an inclination of the first recording position to the moving direction based on the acquired amount of inclination, wherein the controller causes the first and second discharge port arrays to record the plurality of patterns without involving conveyance of the recording medium.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 13 illustrates an arrangement of dots when there is no inclination in a recording position.

FIG. 14 illustrates an arrangement of dots when there is an inclination in a recording position.

FIG. 15 illustrates inclination correction according to an exemplary embodiment of the present invention.

DESCRIPTION OF THE EMBODIMENTS

Various exemplary embodiments, features, and aspects of the invention will be described in detail below with reference to the drawings.

Figure 1:
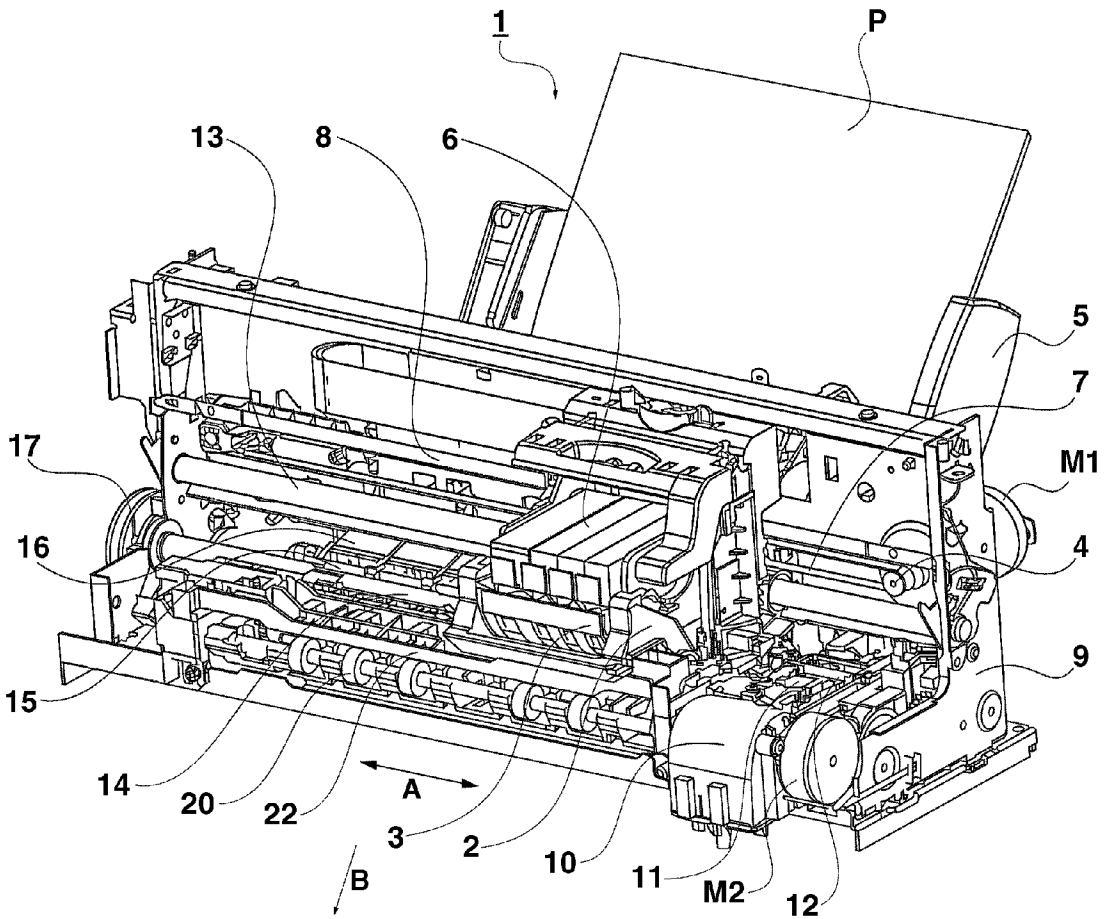
FIG. 1 is an appearance perspective view illustrating an inkjet recording apparatus.

FIG. 1 is an appearance perspective view illustrating a configuration of an inkjet recording apparatus 1 which is a typical exemplary embodiment according to the present invention. As illustrated in FIG. 1, the inkjet recording apparatus 1 (hereinafter, also referred to as recording apparatus) reciprocatively moves a carriage 2 mounting a recording head 3 in a direction of arrow A. The recording head 3 discharges an ink droplet to execute recording according to an inkjet method. With movement of the carriage 2, the inkjet recording apparatus 1 feeds and conveys a recording medium P, for example a recording sheet, via a paper feed mechanism 5 to a recording position, and discharges ink droplets from the recording head 3 to the recording medium P at the recording position to execute recording. The inkjet recording apparatus 1 transmits driving force generated by a carriage motor M1 to the carriage 2 mounting the recording head 3 via a transmission mechanism 4.

On the carriage 2 of the recording apparatus 1, not only the recording head 3 but also an ink cartridge 6 for storing ink to be supplied to the recording head 3 are mounted. The ink cartridge 6 is freely attached to and detached from the carriage 2. Further, the carriage 2 includes a single optical sensor (not illustrated) to be used in reading of a test pattern or the like.

The carriage 2 and the recording head 3 are suitably brought into contact with each other at joint surfaces of both members so that an electric connection can be achieved and maintained. The recording head 3 selectively discharges ink from a plurality of discharge ports (also, referred to as nozzle) to execute recording by applying energy to the ink in response to a recording signal. The recording head 3 adopts an inkjet method of discharging ink using thermal energy and includes an electrothermal converter (recording element) for generating the thermal energy. The recording head 3 uses a pressure change caused by growth and shrinkage of an air bubble owing to film boiling of ink which is generated by converting electric energy applied to the electrothermal converter into thermal energy and providing the thermal energy, and discharges the ink from the discharge port. This electrothermal converter is provided corresponding to each of the respective discharge ports. A pulse voltage is applied to the electrothermal converter according to the recording signal, so that ink is discharged from the discharge port corresponding to the electrothermal converter.

As illustrated in FIG. 1, the carriage 2 is connected to a part of a driving belt 7 on the transmission mechanism 4 for transmitting the driving force of the carriage motor M1. The carriage 2 is guided and supported so as to be freely slid in the direction of arrow A along a guide shaft 13. Accordingly, the carriage 2 is reciprocatively moved along the guide shaft 13 by normal rotation and reverse rotation of the carriage motor M1. Further, the carriage 2 includes a scale 8 for indicating an absolute position of the carriage 2 along a moving direction (direction of arrow A) of the carriage 2. In the present exemplary embodiment, the scale 8 is made of a transparent polyethylene terephthalate (PET) film on which a black bar is printed with a pitch. One end of the scale 8 is secured to a chassis 9 and the other is supported by a plate spring (not illustrated).

The recording apparatus 1 includes a platen (not illustrated) that faces a discharge port face on which the discharge port (not illustrated) of the recording head 3 is formed. The carriage 2 mounting the recording head 3 is reciprocatively moved by the driving force of the carriage motor M1. At the same time, the recording apparatus 1 provides the recording head 3 with the recording signal to discharge ink. Thus, recording is executed over the entire width of the recording medium P conveyed on the platen.

In FIG. 1, a conveyance roller 14 is driven by a conveyance motor M2 to convey the recording medium P in a conveyance direction (direction of arrow B). A pinch roller 15 attaches the recording medium P to the conveyance roller 14 by a spring (not illustrated). A pinch roller holder 16 supports the pinch roller 15 so as to freely rotate. A conveyance roller gear 17 is secured to one end of the conveyance roller 14. The conveyance roller 14 is driven by rotation of the conveyance motor M2 which is transmitted to the conveyance roller gear 17 via an intermediate gear (not illustrated).

Further, a discharge roller 20 discharges the recording medium P on which an image is formed by the recording head 3 outside the recording apparatus. The discharge roller 20 is driven by the rotation of the conveyance motor M2 which is transmitted thereto. The discharge roller 20 abuts on the recording medium P by a spur roller (not illustrated) which is contacted therewith by pressure by a spring (not illustrated). A spur holder 22 supports the spur roller so as to freely rotate.

Figure 2:
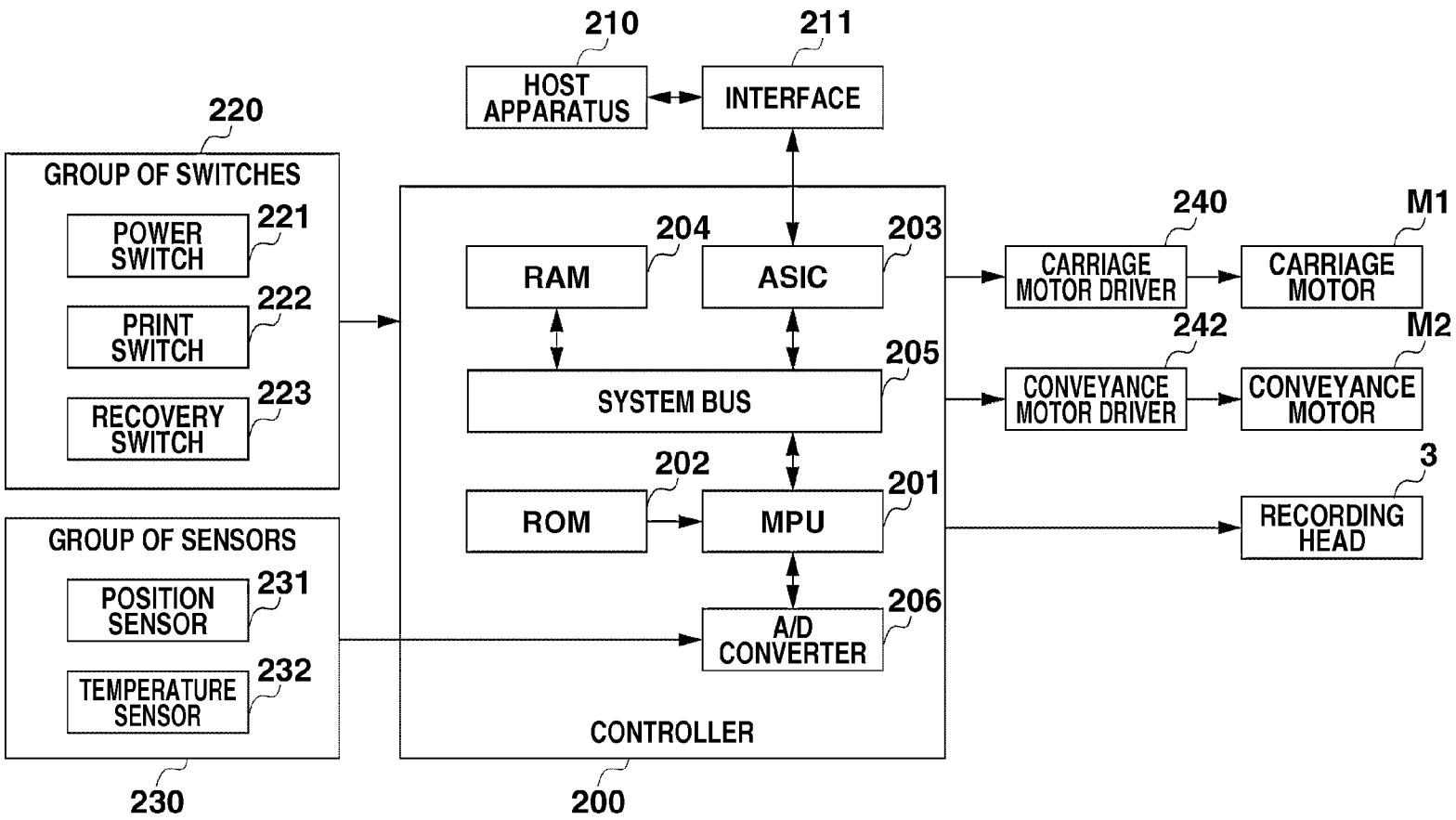
FIG. 2 illustrates a block diagram of an inkjet recording apparatus.

FIG. 2 is a block diagram illustrating a control configuration of the recording apparatus 1 illustrated in FIG. 1. As shown in FIG. 2, a controller 200 includes a micro processing unit (MPU) 201, a read only memory (ROM) 202, an application specific integrated circuit (ASIC) 203, a random access memory (RAM) 204, a system bath 205, an analog-to-digital (A/D) converter 206, and the like.

The ROM 202 stores a program or the like for executing recording position adjustment described below. The ASIC 203 generates control signals for respectively controlling the carriage motor M1, the conveyance motor M2, and the recording head 3. The RAM 204 includes a rasterization area for image data, a working area for executing a program, and the like. The RAM 204 serves as a unit configured to store an adjusted value acquired by recording position adjustment control.

The system bath 205 mutually connects the MPU 201, the ASICS 203, and the RAM 204 to execute transmission and receiving of data. Further, the A/D converter 206 inputs an analog signal from a group of sensors described below to execute A/D conversion and supplies a digital signal to the MPU 201.

In FIG. 2, a computer 210 (alternately, a reader for reading image, a digital camera or the like) is a supply source of image data and is generically referred to as a host apparatus. Between the host apparatus 210 and the recording apparatus 1, image data, a command, and a status signal are transmitted and received via an interface (I/F) 211.

A group of switches 220 includes a power source switch 221, a print switch 222 for commanding a printing start, a recovery switch 223 for commanding start of processing (recovery processing) in order to remain ink discharge performance of the recording head 3 in an excellent state, and the like. Further, in the case where a user reads a test pattern for recording position adjustment, a switch for inputting a reading result may be provided.

A group of sensors 230 for detecting a state of the apparatus includes a position sensor 231 such as a photo-coupler for detecting a home position, a temperature sensors 232 provided on appropriate places in the recording apparatus for detecting an environmental temperature, and the like.

A carriage motor driver 240 drives the carriage motor M1 for reciprocatively moving the carriage 2 in the direction of arrow A. A conveyance motor driver 242 drives the conveyance motor M2 for conveying the recording medium P.

In the configuration described above, the recording apparatus 1 analyzes a command of recorded data transferred via the interface 211 and rasterizes image data to be used in recording into the RAM 202. The ASIC 203 transfers drive data (DATA) on a recording element to the recording head while directly accessing a storage area of the RAM 202 in a movement with ink discharge of the recording head 3.

Figure 3B:
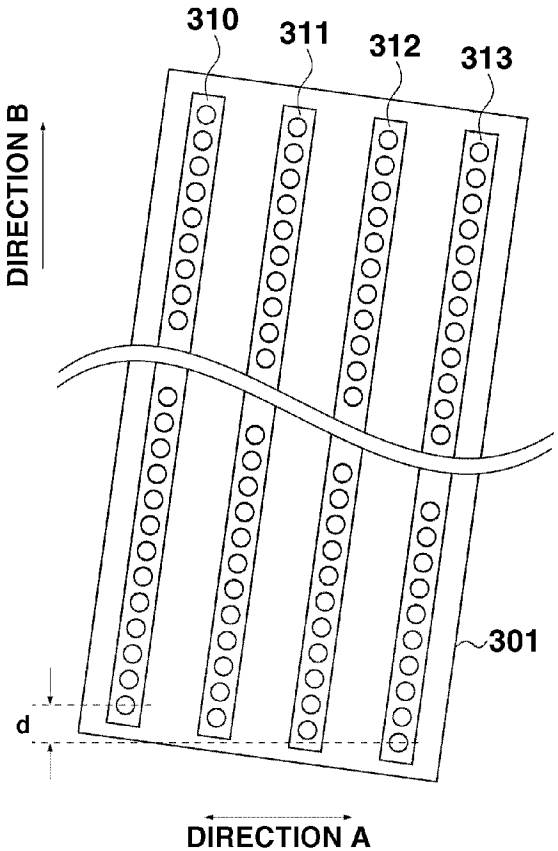
FIGS. 3A and 3B are schematic diagrams illustrating a configuration of a recording head.
Figure 3A:
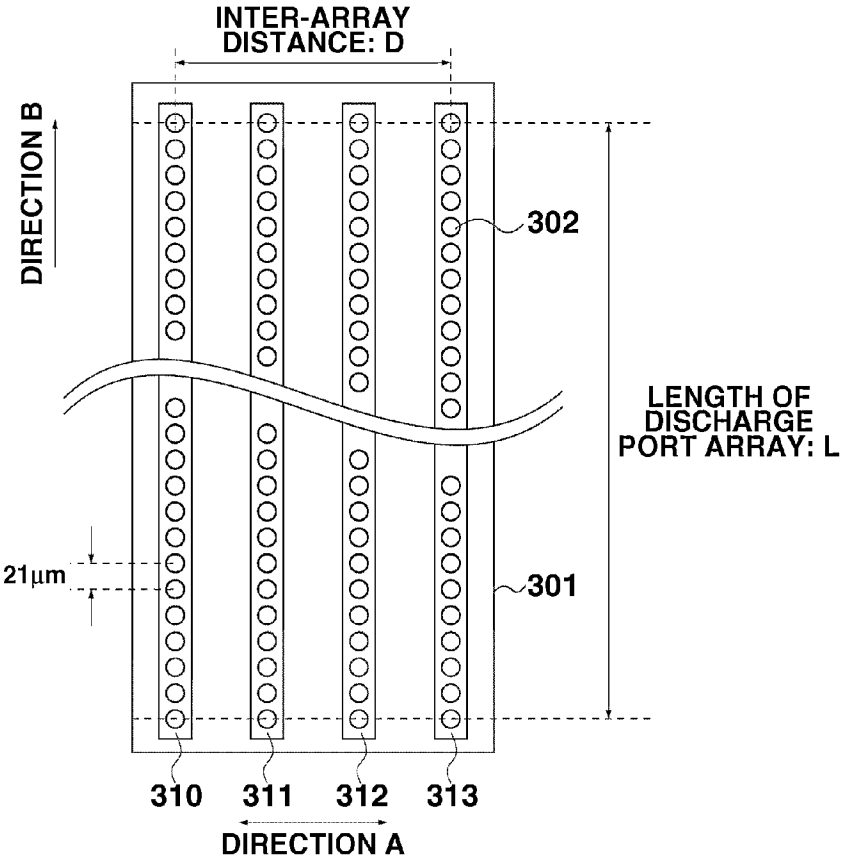

FIGS. 3A and 3B are schematic diagrams illustrating a configuration of the recording head 3 on the recording apparatus 1 illustrated in FIG. 1. As illustrated in FIG. 3A, four rows of discharge port arrays 310, 311, 312 and 313 are arranged on a chip 301 of the recording head 3 along a moving direction (direction A). The discharge port array 310 is a discharge port array in which 256 discharge ports 302 for discharging black ink are arranged at intervals of 21 μm (discharge port arrangement resolution is 1,200 dots per inch (dpi)) along a direction B. Further, the discharge port array 311 is a discharge port array for discharging yellow ink, the discharge port array 312 is a discharge port array for discharging magenta ink, and the discharge port array 313 is a discharge port array for discharging cyan ink. The number of discharge ports and the discharge port arrangement resolution of each of these discharge port arrays 311 to 313 are equal to those of the black discharge port array 310. A length between the center of a discharge port located on the most upstream side and the center of a discharge port located on the most downstream side in a conveyance direction of the respective discharge arrays is defined as a length of a discharge port array L. Further, in the present exemplary embodiment, a distance between the center of the black discharge port array 310 and the center of the cyan discharge port array 313 is referred to as an inter-array distance, and the distance thereof is denoted as D.

The detail of recording position adjustment control in the present exemplary embodiment will be described below. The recording position adjustment control in the present exemplary embodiment is to adjust the recording position of a dot to be recorded by the same discharge port array. More specifically, the recording position adjustment control is to adjust an inclination to a moving direction of the dot to be recorded by the same discharge port array. The recording position adjustment control is executed in the order of recording of a test pattern, reading of the test pattern, and calculation of an amount of inclination (adjusted value). An inclination in a recording position is corrected when actual recording is executed based on the calculated adjusted value. In the present exemplary embodiment, the amount of inclination which indicates the extent of an inclination corresponds to an amount of displacement in the moving direction between one end and another end of the discharge port array and is determined by the length of the discharge port array and an inclination angle.

FIG. 3B illustrates a discharge port array when the recording head 3 is mounted on the recording head 3 inclined to the recording apparatus 1. In the recording head in the present exemplary embodiment, four rows of the discharge port arrays 310 to 313 are formed on the same chip 301 and a relative position accuracy of the discharge port arrays 310 to 313 is significantly high. Accordingly, there is very few case in which only one discharge port array is inclined. Thus, inmost cases, the discharge port arrays 310 to 313 are inclined in the same amount of inclination because the chip 301 is arranged with inclination to the recording head 3 and the recording head 3 is arranged with inclinations to the recording apparatus 1. Accordingly, a common adjusted value is acquired from the discharge port arrays 310 to 313 and when actual recording is executed, correction is executed in the discharge port arrays 310 to 313 according to the same adjusted value.

Further, as may be seen from FIG. 3B, if the discharge port arrays 310 to 313 are inclined, displacement d is generated between two discharge port arrays (e.g., black discharge port array 310 and cyan discharge port array 313) in the conveyance direction. The displacement d is correlative with the inclination angle (amount of inclination) of each discharge port array. The larger the amount of inclination becomes, the larger the displacement d becomes. The present exemplary embodiment is characterized in that a test pattern for detecting the amount of inclination is recorded using correlation between the displacement d and the amount of inclination in the conveyance direction.

The test pattern in the present exemplary embodiment is a test pattern for detecting the amount of displacement between two rows of the discharge port arrays which are formed on the same chip in a conveyance direction. As described above, the amount of displacement between two rows of the discharge port arrays in the conveyance direction is correlative with an inclination angle of the chip 301 to the recording head 3, namely an inclination angle (amount of inclination) of each discharge port array. Therefore, if the amount of displacement between two rows of the discharge port arrays in the same chip in the conveyance direction is detected, the amount of inclination of each discharge port array in the chip can be acquired from the amount of displacement. A recording method of the test pattern in the present exemplary embodiment will be described below.

Figure 4:
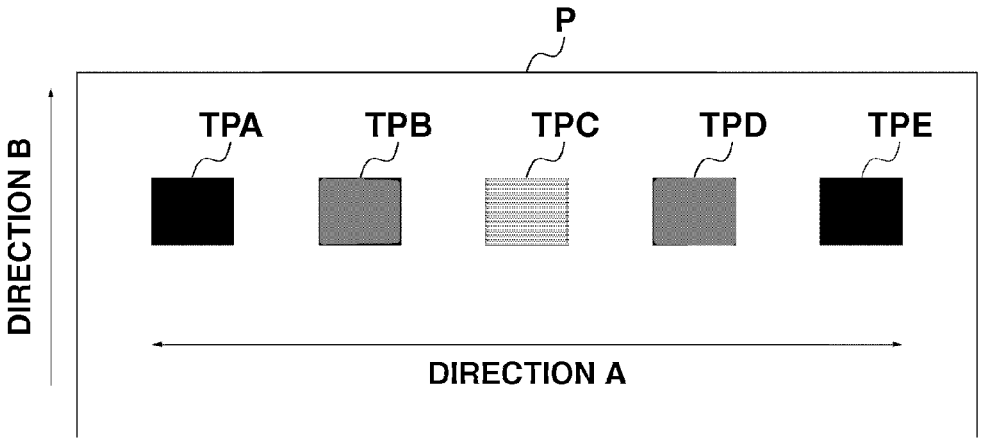
FIG. 4 illustrates a general view of a test pattern.

FIG. 4 illustrates a test pattern TP to be recorded on the recording medium P according to the present exemplary embodiment. As illustrated in FIG. 4, the test pattern TP includes five patterns TPA to TPE along the moving direction (direction A) of the recording head. A size of each pattern is 320 [dot/600 dpi] in a scanning direction and 128 [dot/600 dpi] in the conveyance direction. Further, each of the patterns TPA to TPE are recorded using two rows of the discharge port arrays in the chip 301 in one movement of the recording head 3.

Between two rows of the discharge port arrays which are used in recording of the test pattern TP, a discharge port array in which the same discharge port is used in recording of each pattern is set to a reference discharge port array and a discharge port array in which a different discharge port is used in recording of each pattern is set to a non-reference discharge port array. In the present exemplary embodiment, the black discharge port array 310 is set to the reference discharge port array (first discharge port array) and the cyan discharge port array 313 is set to the non-reference discharge port array (second discharge port array). When each of a plurality of discharge port arrays is inclined, the larger an interval between two rows of the discharge port arrays becomes, the larger the amount of displacement in the conveyance direction becomes. Thus, the amount of displacement is easily detected from the test pattern. Accordingly, in the present exemplary embodiment, the black discharge port array and the cyan discharge port array which are arranged most outside among the discharge port arrays 310 to 313 in the moving direction are used in recording of the test pattern.

Figure 5:
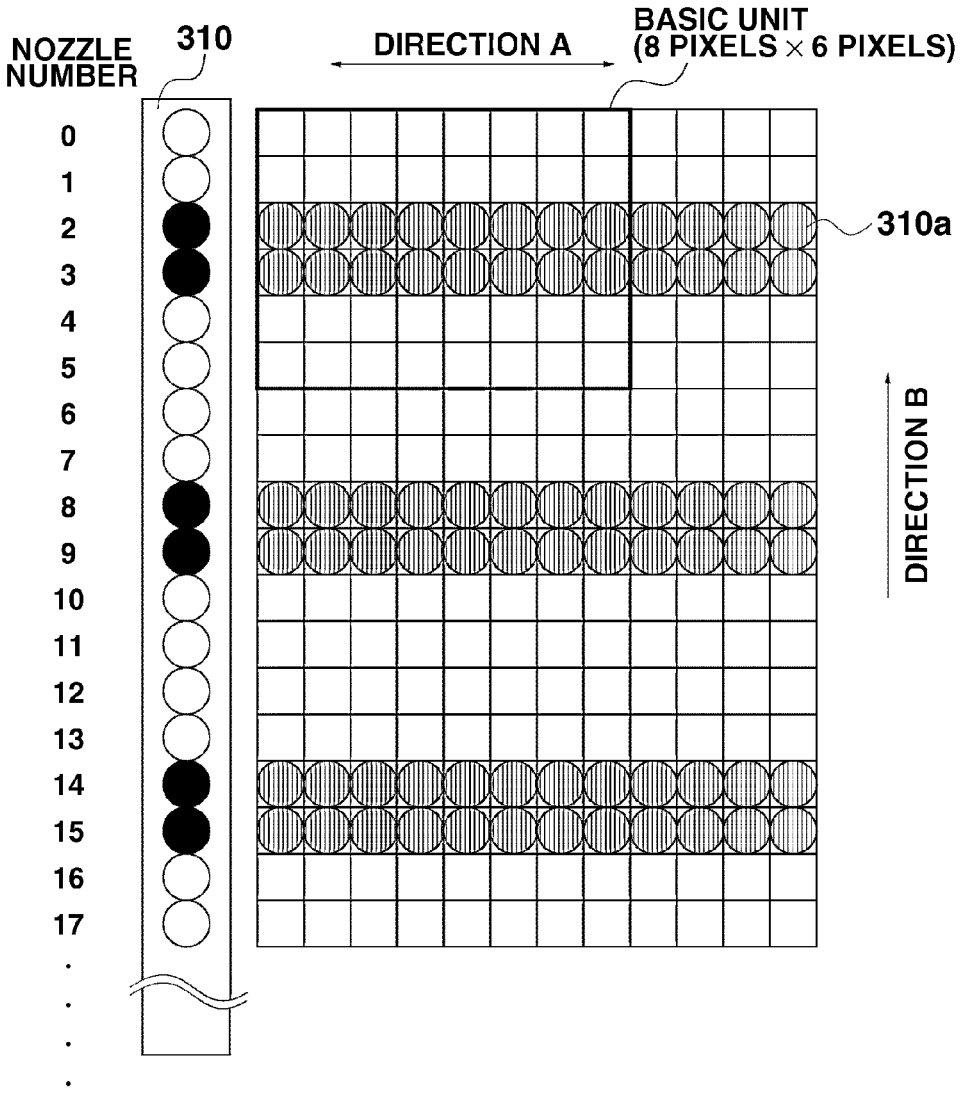
FIG. 5 illustrates a dot pattern to be recorded by a reference discharge port array.

FIG. 5 illustrates discharge ports which are used in recording of the test pattern TP by the black discharge port array 310 serving as the reference discharge port array, and a pattern of dots 310*a* which is recorded by these discharge ports. A square (pixels) in which dots are arranged has 600 dpi in the conveyance direction (direction B)×1,200 dpi in the moving direction (direction A). In the recording head according to the present exemplary embodiment, a discharge port number (also, referred to as nozzle number) is allocated as 0, 1, 2 . . . in order from a discharge port on the downstream side in the conveyance direction of the discharge port array. FIG. 5 illustrates only 18 discharge ports of discharge port numbers 0 to 17 among 256 discharge ports. Further, FIG. 5 also illustrates a dot pattern to be recorded only for 14 pixels×18 pixels.

In FIG. 5, among the discharge ports on the black discharge port array 310, discharge ports indicated by black are discharge ports to be used. In other words, in the black discharge port array 310 illustrated in FIG. 5, discharge ports of discharge port numbers 2, 3, 8, 9, 14 and 15 are used in recording of the test pattern, and fill a predetermined dot pattern with a basic unit U (8 pixels*6 pixels). The black discharge port array 310 serving as the reference discharge port array uses the same discharge port and records the same dot pattern in all of the patterns TPA to TPE.

Next, FIGS. 6A, 7A, 8A, 9A and 10A illustrate discharge ports to be used in the cyan discharge port array 313 serving as the non-reference discharge port array and a pattern of dots 313*a* to be recorded by these discharge ports in the patterns TPA to TPE.

Further, FIGS. 6B, 7B, 8B, 9B and 10B illustrate a final dot pattern adding up the dot pattern of the reference discharge port array and the dot pattern of the non-reference discharge port array in the patterns TPA to TPE. In FIGS. 6B, 7B, 8B, 9B and 10B, the black dot 310*a* is illustrated in a pixel in which the black dot 310*a* and the cyan dot 313*a* are superposed. Further, in FIGS. 6A and 6B to 10A and 10B, a unit of a square (pixel) in which dots are arranged, a method for allocating a discharge port number, illustrating only 18 discharge ports, and illustrating a dot pattern only for 14 pixels× 18 pixels are common to those in FIG. 5.

Figure 6B:
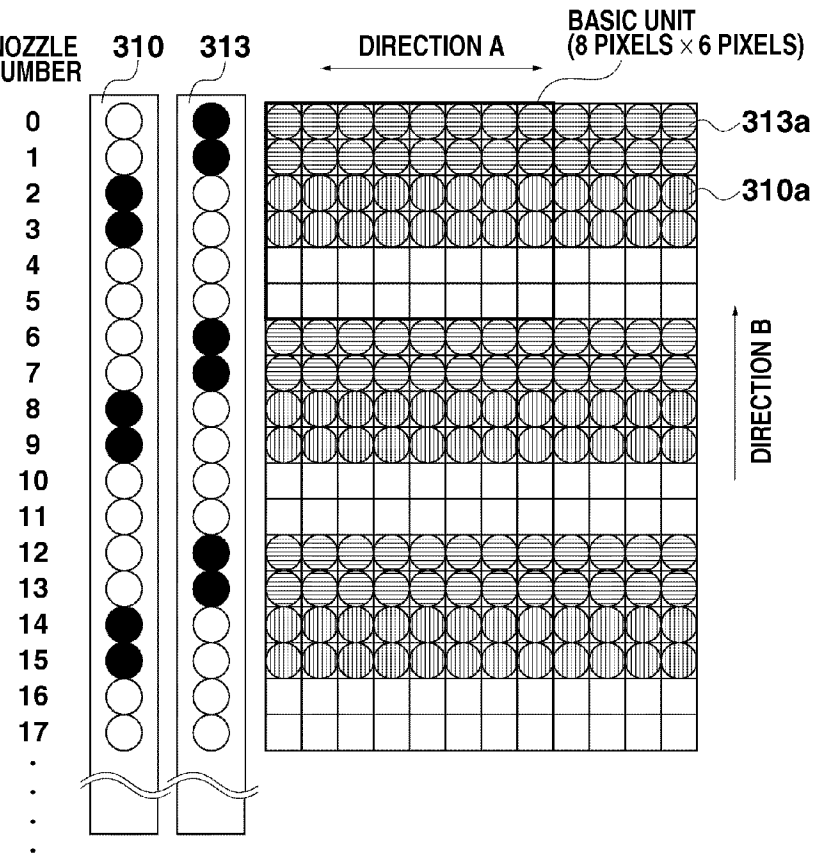
FIGS. 6A and 6B illustrate a dot pattern whose amount of displacement of a non-reference discharge port array is −2.
Figure 6A:
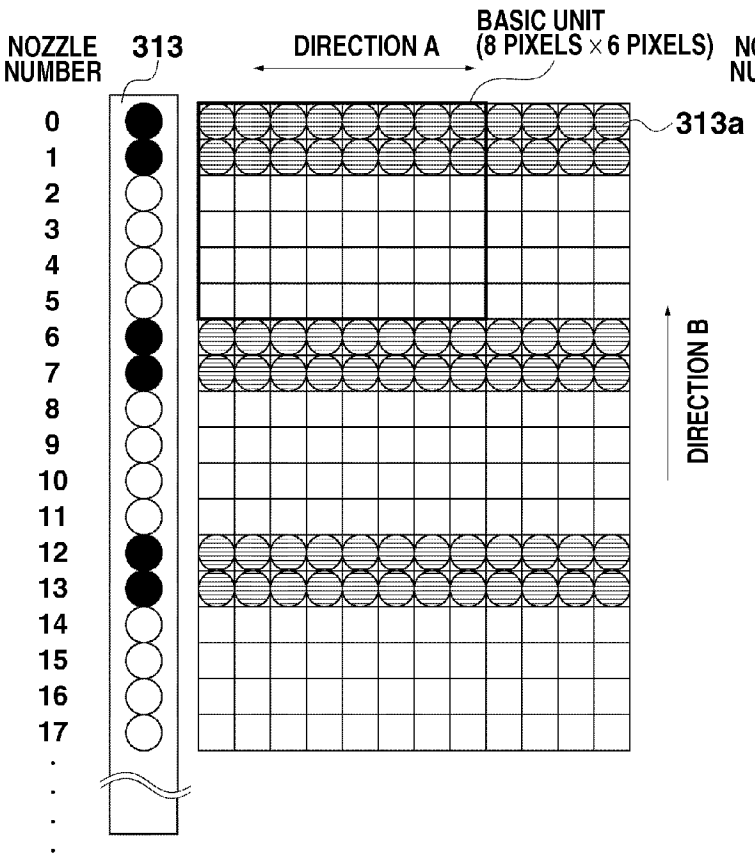
Figure 7A:
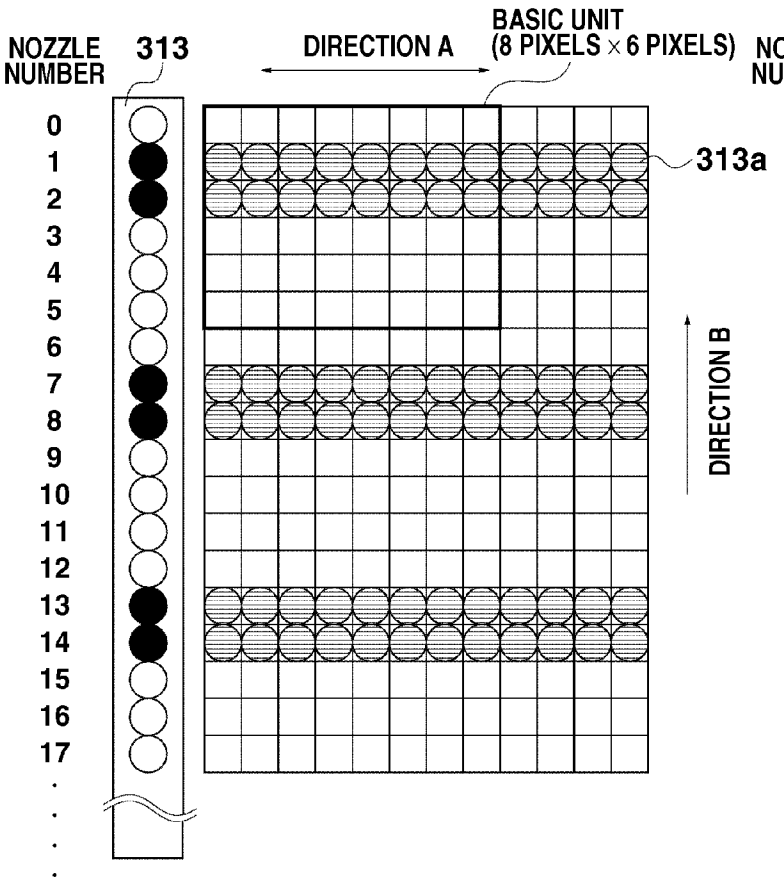
FIGS. 7A and 7B illustrate a dot pattern whose amount of displacement of a non-reference discharge port array is −1.
Figure 7B:
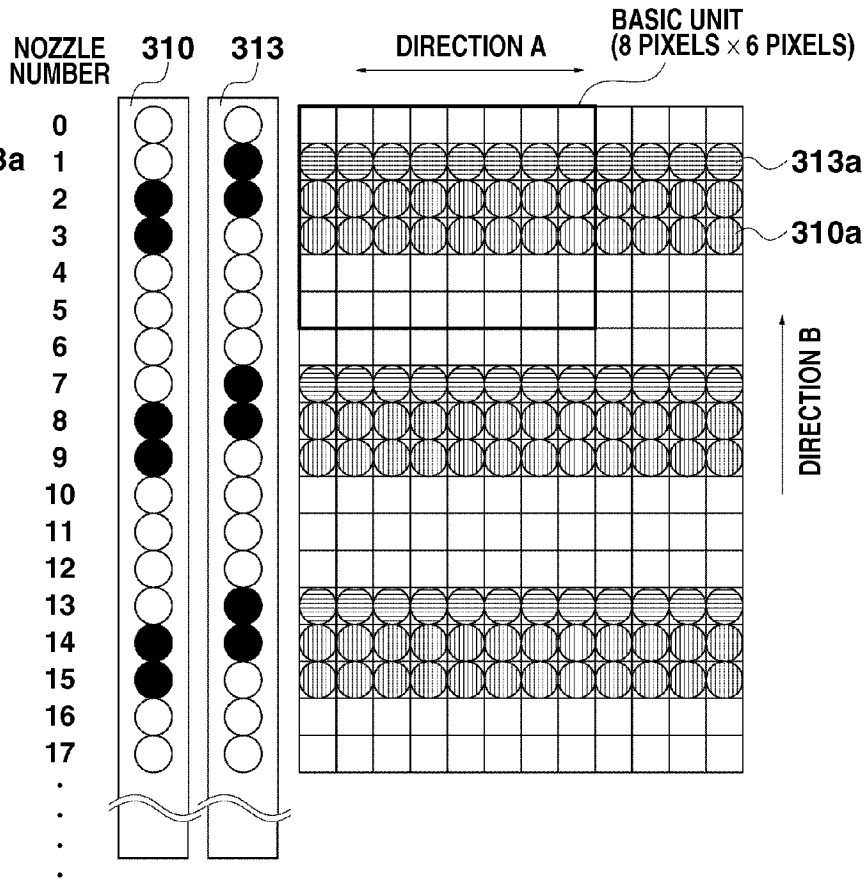
Figure 8A:
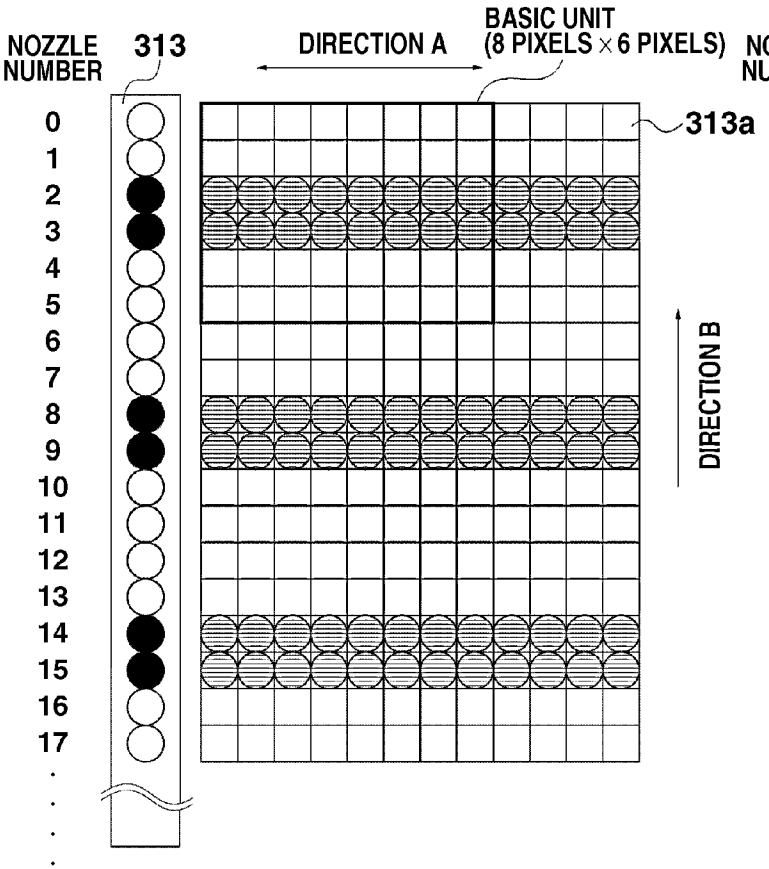
FIGS. 8A and 8B illustrate a dot pattern whose amount of displacement of a non-reference discharge port array is 0.
Figure 8B:
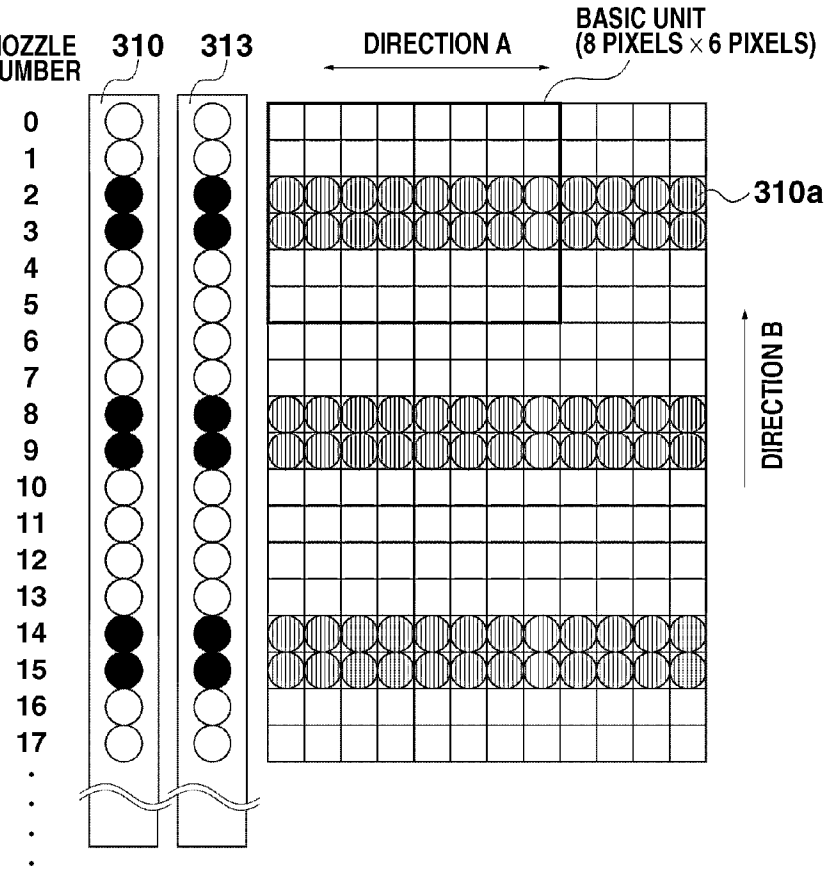
Figure 9A:
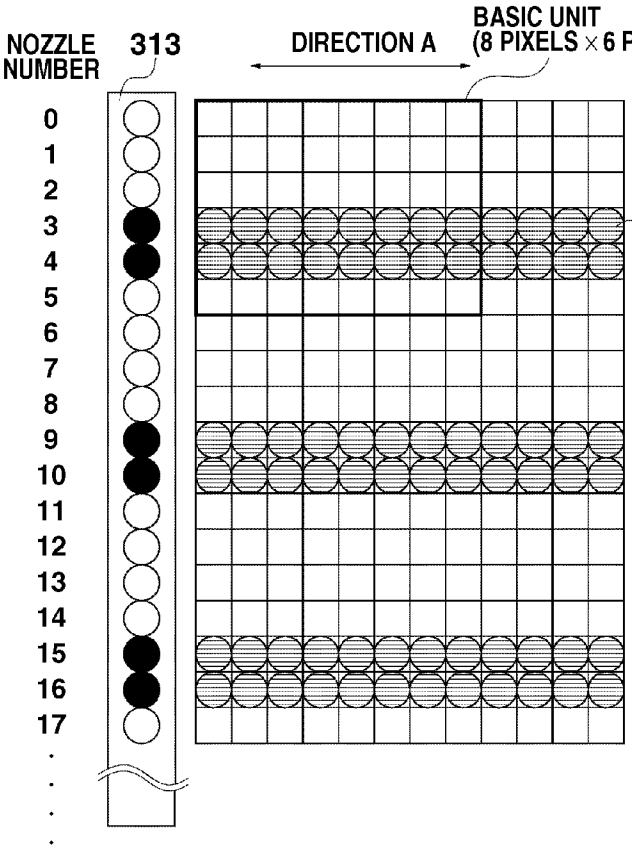
FIGS. 9A and 9B illustrate a dot pattern whose amount of displacement of a non-reference discharge port array is +1.
Figure 9B:
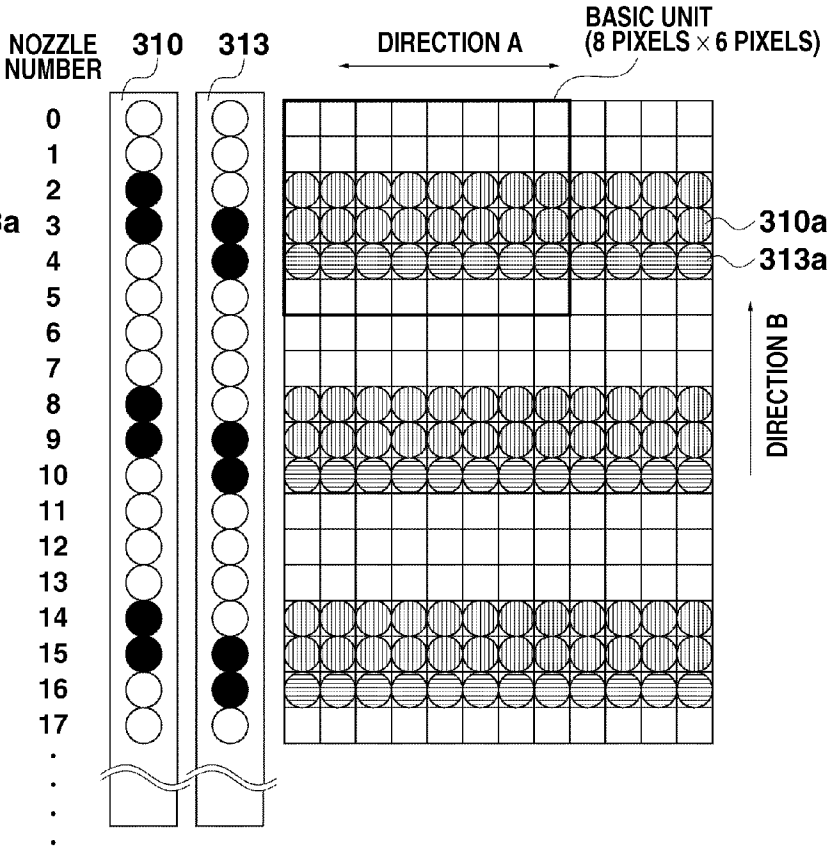
Figure 10A:
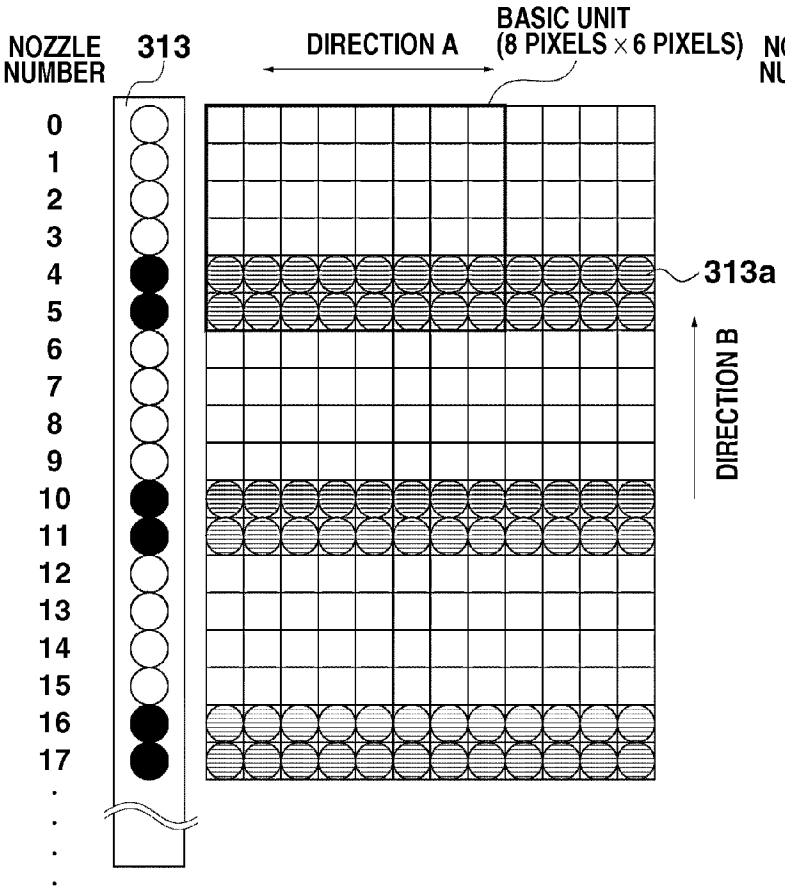
FIGS. 10A and 10B illustrate a dot pattern whose amount of displacement of a non-reference discharge port array is +2.
Figure 10B:
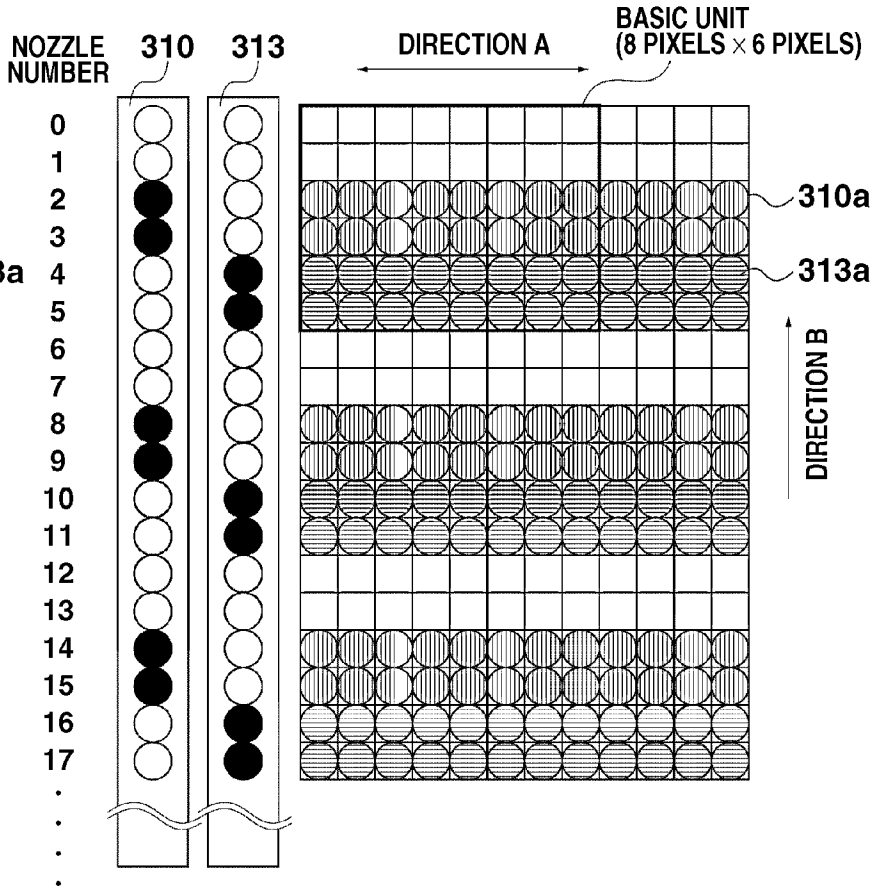

FIG. 6A illustrates discharge ports which are used by the cyan discharge port array 313 serving as the non-reference discharge port array in recording of the pattern TPA, and a dot pattern to be recorded by these discharge ports. In FIG. 6A, discharge ports to be used by the cyan discharge port array 313 in recording of the pattern TPA are discharge ports of discharge port numbers 0, 1, 6, 7, 12 and 13, and these discharge ports fill the predetermined dot pattern with the basic unit (8 pixels*6 pixels).

FIG. 6B illustrates a final dot pattern of the pattern TPA in which the dot pattern of the reference discharge port array illustrated in FIG. 5 and the dot pattern of the non-reference discharge port array illustrated in FIG. 6A are added. The pattern TPA is a pattern in which the dot pattern of the non-reference discharge port array is displaced by two pixels on the downstream side in the conveyance direction to the dot pattern of the reference discharge port array, and in which the amount of displacement is −2.

FIGS. 7A, 8A, 9A and 10A illustrate discharge ports which are used in recording of the patterns TPB to TPE by the cyan discharge port array 313 serving as the non-reference discharge port array, and a dot pattern to be recorded by these discharge ports. As it is obvious from FIGS. 6A, 7A, 8A, 9A and 10A, in the non-reference discharge port array, the discharge port is used by displacing it one by one for each pattern.

Further, FIGS. 7B, 8B, 9B and 10B illustrate a final dot pattern of the patterns TPB to TPE respectively, in which the dot pattern of the reference discharge port array illustrated in FIG. 5 is added to the dot pattern of the non-reference discharge port array illustrated in FIGS. 7A, 8A, 9A and 10A. Thus, in the non-reference discharge port array, the discharge port is used by displacing it one by one for each pattern, so that five patterns whose amount of displacement is −2 to +2 are recorded.

In the present exemplary embodiment, the patterns TPA to TPE which are configured by the above-described dot pattern are recorded by one movement of the recording head. Accordingly, when the test pattern is recorded, since conveyance of a recording medium is not involved, the amount of inclination can be acquired without being affected by a conveyance error.

After the patterns TPA to TPE have been recorded by one movement of the recording head, reading of the patterns TPA to TPE is executed by an optical sensor mounted on the carriage 2. The lower state a recorded density of a pattern is provided in, the smaller detected value (output AD value) the optical sensor indicates.

Figure 11:
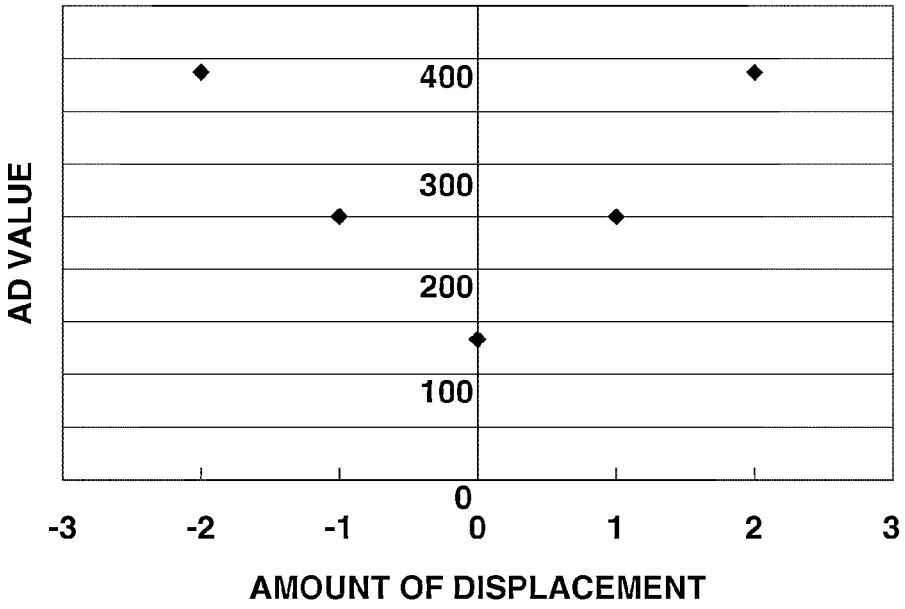
FIG. 11 illustrates a relation between each of test patterns and an AD value.

FIG. 11 illustrates AD values of the patterns TPA to TPE when the discharge port arrays 310 to 313 are not inclined, in other words, when the black discharge port array 310 of the reference discharge port array and the cyan discharge port array 313 of the non-reference discharge port array are not displaced in the conveyance direction. If the recording position of the black discharge port array 310 and the recording position of the cyan discharge port array 313 are matched in the conveyance direction, the dot pattern of the black discharge port array and the dot pattern of the cyan discharge port array are perfectly overlapped each other in the pattern TPC whose amount of displacement is 0, so that the AD value becomes minimum.

In order to determine the amount of displacement between the black discharge port array 310 and the cyan discharge port array 313 in the conveyance direction, the amount of displacement β when the AD value is minimized is calculated. The amount of displacement of a pattern which indicates a minimum AD value can simply be set to a value β from among the patterns TPA to TPE. However, the value β may be calculated using interior division calculation. Thus, the value β may be determined by a numeral value less than a unit of the amount of displacement of the patterns TPA to TPE. In the present exemplary embodiment, a range of the amount of displacement of +1 to −1 is divided into 32 parts and the amount of displacement which obtains the minimum AD value is calculated in the 32 parts. In the present exemplary embodiment, the interval of the discharge port is 21 μm (1,200 dpi) and the amount of displacement of the test pattern is in a unit of a discharge port. Thus, the amount of displacement can be determined by resolution of 1.3 μm which is obtained by dividing the interval of the discharge port into 32 parts.

Figures 12A, 12B:
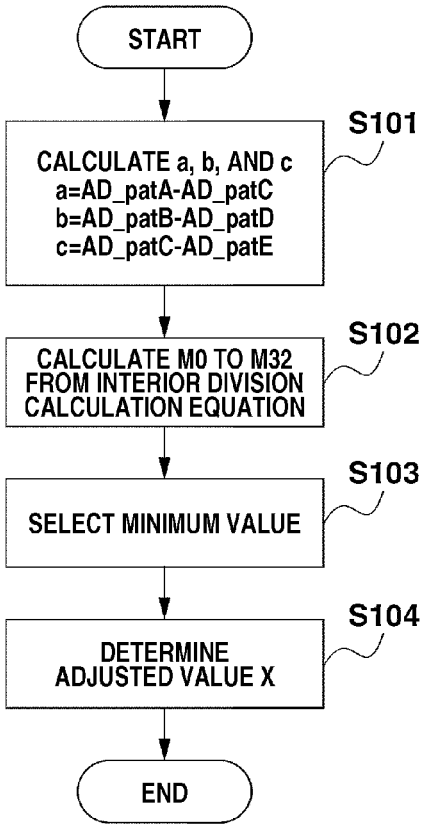
FIGS. 12A and 12B illustrate a flowchart for calculating an amount of displacement β.

FIG. 12A is a flowchart illustrating a procedure for calculating the amount of displacement β which minimizing the AD value using interior division calculation. First, in step S101, coefficients a, b, and c are calculated by the following equation 1:

$$a=AD_PatA-AD_PatC$$

$$b=AD_PatB-AD_PatD$$

$$c=AD_PatC-AD_PatE \tag{1}$$

where AD_PatX denotes an AD value to be obtained by a pattern TPX.

Next, in step S102, in order to determine the amount of displacement of a minimum AD value in 1.3 μm unit which is obtained by dividing the range of the amount of displacement of +2 to −2 into 32 parts, M0 to M32 are calculated by an interior division calculation equation (2) in which the coefficients a, b, and c are multiplied by coefficients of 0 to 15.

$$\begin{aligned} M0 &= |16*a+0*b+0*c| \\ M1 &= |1*a+1*b+0*c| \\ &\cdots \\ M15 &= |1*a+15*b+0*c| \\ M16 &= |0*a+16*b+0*c| \\ M17 &= |0*a+15*b+1*c| \\ &\cdots \\ M32 &= |0*a+0*b+15*c| \end{aligned} \tag{2}$$

where, for example, M0 is an AD value when the amount of displacement is −21.2 μm (in other words, "−2") and M1 is an AD value when the amount of displacement is −19.8 μm. More particularly, in FIG. 12B, the respective coefficients a, b and c, and the amount of displacement of M0 to M32 are illustrated.

Next, in step S103, the minimum value is selected from among M0 to M32 calculated in step S102. Thus, the amount of displacement β when the AD value is minimized can be determined.

In the present exemplary embodiment, as described below, in inclination correction which corrects an inclination in the recording position, correction is executed by displacing the recording position of a dot to the moving direction of the recording head. Then, in step S104, the amount of displacement β calculated for the correction is converted into the amount of displacement X between the black discharge port array and the cyan discharge port array in a moving direction. As the following equation 3, the amount of displacement X (adjusted value) in the moving direction can be calculated based on the obtained amount of displacement β.

$$X=L/D*\beta \tag{3}$$

where D is the inter-array distance and L is the length of the discharge port array as described in FIG. 3.

The inclination correction is to correct an inclination of a dot to be recorded by the same discharge port array when actual recording is executed based on the adjusted value calculated by the above described procedure. In the present exemplary embodiment, correction of the black discharge port array 310 will be described. However, the similar correction is executed to all of the discharge port arrays 310 to 313 formed on the same chip 301. The detail of the inclination correction will be described below.

FIG. 13 illustrates an arrangement of dots which is recorded on the recording medium P by the black discharge port array when there is no inclination in the recording position of the black discharge port array 310. In FIG. 13, pixels into which dots are arranged are 1,200 dpi in the moving direction×600 dpi in the conveyance direction similarly to those in FIGS. 5 to 10. FIG. 13 illustrates the arrangement of dots for 3 pixels*256 pixels.

Further, in the present exemplary embodiment, a recording element (heater) which is provided corresponding to each of the discharge ports of the black discharge port array is divided into 16 groups of block numbers 0 to 15, and recording is executed by using a time division driving method in which drive timing for each block is shifted in recording. 16 recording elements included in the same block are simultaneously driven in the order of block numbers 0 to 15 to accomplish recording of one pixel (one column) in the moving direction. Further, in addition to grouping by the block number, 256 discharge ports are divided into a group of 16 discharge ports each (group numbers 0 to 15) from the discharge port on the downstream side in THE conveyance direction. As it is obvious from the arrangement of dots in FIG. 13, when there is no inclination in the black discharge port array 310, the dot is recorded in the predetermined pixel and excellent image recording can be realized.

FIG. 14 illustrates an arrangement of dots which is recorded on the recording medium P by the black discharge port array when there is an inclination in the recording position of the black discharge port array 310. When the black discharge port array 310 is inclined, a dot is not recorded in the predetermined pixel, so that the quality of an image may be reduced. As illustrated in FIG. 14, when the black discharge port array 310 is inclined in a clockwise direction, a dot recorded by a discharge port which is included in groups (groups 14 and 15 in this case) on the upstream side in the conveyance direction is relatively displaced to a left direction in FIG. 14. Thus, the dot is not recorded in the predetermined pixel.

FIG. 15 illustrates the detail of the inclination correction. The inclination correction in the present exemplary embodiment executes correction for displacing only recorded data of a discharge port by which a dot is not recorded in the predetermined pixel in the moving direction (direction A). In the present exemplary embodiment that adapts the time division driving method, as illustrated in FIG. 15, when the black discharge port array is inclined, in group 14, dots of five discharge ports of block numbers 0 to 4 are not recorded in the predetermined pixel. Further, in group 15, dots of six discharge ports of block numbers 0 to 5 are not recorded in the predetermined pixel. Accordingly, as illustrated in FIG. 15, in group 14, the recorded data pieces on five discharge ports of block numbers 0 to 4 are displaced in a right direction by one pixel, and in group 15, the recorded data pieces on six discharge ports of block numbers 0 to 5 are displaced in the right direction by one pixel. Thus, dots of all discharge ports are recorded in the predetermined pixel, and reduction in the quality of an image may be decreased.

As described above, the inclination correction in the present exemplary embodiment is to displace recorded data pieces on the N discharge ports when dots of block numbers 0 to N are not recorded in the predetermined pixel. The above-described value N varies according to a group and the amount of inclination. In other words, the closer the group (group with large group number) is located to the upstream side in the conveyance direction, the larger the value N becomes. Even if it is the same group, the larger the amount of inclination becomes, the larger the value N becomes. Thus, in the present exemplary embodiment, a table is stored in which the above described adjusted value is associated with the number of discharge ports N for displacing recorded data in the moving direction in each group.

In the inclination correction, recorded data pieces from block number 0 to a designated number are displaced based on the value N for each group to be acquired from the adjusted value. Further, in groups (e.g., groups 12 and 13) which have been omitted to illustrate in FIG. 15, recorded data pieces on discharge ports of a number designated based on the adjusted value may be displaced in a similar manner as described above. Furthermore, when the discharge port array is inclined in a counterclockwise direction, a dot recorded by a discharge port in a group on the upstream side in the conveyance direction is relatively displaced in the right direction in FIG. 15. Thus, recorded data of a discharge port designated based on the adjusted value may be displaced in the left direction.

In the inclination correction, data processing for displacing recorded data will be described. As an arrangement of the recorded data in a storage area of the RAM 202, the recorded data of a discharge port number 0 is stored on b0 of an address 000 and the recorded data of a next column of the discharge port number 0 is stored on b1 in the same address 000. Thus, in a horizontal direction of the address 000, the recorded data of the discharge port number 0 is stored in the order of columns. In addresses 001 to address 0FE, the recorded data pieces of the discharge port numbers 1 to 256 are similarly stored in the address 000.

In order to transfer the recorded data to the recording head in a column (pixel) unit, the recorded data on a print buffer is subjected to HV conversion. In the present exemplary embodiment, the ASIC 203 can read the recorded data on the print buffer and stores data for two columns. Then, the ASIC 203 selects the recorded data for one column from the recorded data for two columns based on the adjusted value and performs the HV conversion.

For example, a group 15 illustrated in FIG. 15, the ASIC 203 stores blank data for one column and the recorded data in a first column and performs the HV conversion on the data pieces of the discharge port numbers 6 to 15 in the first column and the data pieces corresponding to the discharge port numbers 0 to 5 among blank data pieces. The converted data is transferred to the recording head 3 and recorded in pixels in the first column. Next, the ASIC 203 deletes blank data for one column and newly acquires the recorded data in a second column, so that the recorded data pieces in the first column and the second column are stored. The ASIC 203 performs the HV conversion on the data pieces of the discharge port numbers 6 to 15 in the first column and on the data pieces of the discharge port numbers 0 to 5 in the second column. The recorded data subjected to the HV conversion is transferred to the recording head 3 and recorded in a pixel in the second column. The above described data processing is executed in each group in the discharge port array. Thus, the recorded data of the discharge port designated by the adjusted value is displaced in the moving direction and the inclination of the recording position is corrected.

As described above, in the present exemplary embodiment, the inclination of the dot recorded by the same discharge port can be corrected.

The recording position adjustment control in the present exemplary embodiment is characterized in that the test pattern TP which is configured by the above described patterns TPA to TPE is recorded by one movement of the recording head. In other words, the recording position adjustment control in the present exemplary embodiment does not have to convey a recording medium when a test pattern is recorded. Thus, the amount of inclination can be acquired without being affected by a conveyance error.

However, the present invention is characterized in that a test pattern is recorded without conveying a recording medium to correct an inclination of dots. Thus, it is not necessarily to accomplish recording of the test pattern by one movement of the recording head. For example, as long as a recording medium is not conveyed, recording of a dot pattern by the reference discharge port array and recording of a dot pattern by the non-reference discharge port array may be executed by another way of movement of the recording head.

In a recording head having a configuration in which a plurality of discharge port arrays is separately arranged on a plurality of chips, the amount of inclination is to be acquired for each chip to execute inclination correction. In this case, similarly to the above described exemplary embodiment, a test pattern is to be recorded by setting the most outside two rows of discharge port arrays in the moving direction of the recording head among a plurality of the discharge port arrays in the chip to the reference discharge port array and the non-reference discharge port array.

However, the present invention is not limited to the configuration in which the reference discharge port array and the non-reference discharge port array which record a test pattern are arranged on the same chip. In other words, even in a recording head in which a plurality of discharge port arrays is separately arranged on a different chip, when a relative position accuracy between discharge port arrays is secured, the inclination of the recording position can be corrected from the amount of displacement between the reference discharge port array and the non-reference discharge port array in the conveyance direction.

A method for acquiring the amount of displacement between the reference discharge port array and the non-reference discharge port array in the conveyance direction is not limited to the method that uses a pattern in which an optical density is changed in response to the amount of displacement. For example, a method may be used in which a plurality of patterns which are different in the amount of displacement between two lines is recorded and the amount of displacement between the reference discharge port array and the non-reference discharge port array to the conveyance direction is acquired from a combination in which the amount of displacement between the two lines is the smallest.

More specifically, a plurality of line patterns having a predetermined length in the moving direction is recorded by one nozzle or a plurality of continuous nozzles of the reference discharge port array. Next, a position of one or a plurality of continuous nozzles to be used in the non-reference discharge port array is changed to the plurality of line patterns and a plurality of patterns in which the amount of displacement between the two lines in the conveyance direction is recorded. Then, a combination in which the displacement between the two lines is the smallest is determined by visual inspection of user or an optical sensor. Then, the amount of displacement between the reference discharge port array and the non-reference discharge port array to the conveyance direction can be acquired from the determined amount of displacement.

A recording head is known in which two rows of the discharge port arrays which discharge the same color ink are displaced in the conveyance direction at an interval of less than an interval of discharge port arrays for the purpose of enhancing the density of discharge port arrays. For example, there is a recording head in which each discharge port array of cyan, magenta, yellow, magenta, and cyan is arranged in the moving direction of the recording head and the discharge ports of cyan which are located most outside are displaced by a half interval to the interval of the discharge ports in the conveyance direction. Even in the recording head in such the form, by considering an amount of original displacement between discharge port arrays, inclination correction can be executed from the amount of displacement between the reference discharge port array and the non-reference discharge port array to the conveyance direction, similarly to the above described exemplary embodiment.

Further, in the above-described exemplary embodiment, the amount of displacement between the reference discharge port array and the non-reference discharge port array is acquired from an output AD value of an optical sensor by interior division calculation. However, in the present invention, acquisition of the amount of displacement is not limited to the above example. A secondary approximate curve which is obtained from data of the output AD value of the optical sensor may be calculated by a least squares method, and a point where the AD value is minimized in the approximate curve can be acquired as the minimum amount of displacement.

Further, the present invention has a feature in recording of a test pattern of recording adjustment control. Thus, various methods can be adopted in inclination correction. For example, an inclination of dots to be recorded may be corrected by providing a mechanical mechanism for correcting an inclination of the recording head to the recording apparatus. Further, as discussed in Japanese Patent Application Laid-Open No. 2007-038649, a plurality of discharge port arrays is divided into a plurality of groups and drive timing is shifted in one dot for each group corresponding to the amount of inclination. Thus, displacement of a recording position can also be corrected.

Further, a unit for acquiring an AD value of each pattern of test patterns may include a multisensor in addition to a single optical sensor. Furthermore, in recent years, an inkjet recording apparatus mounting a scanner unit has become the mainstream. Thus, the scanner unit may be used.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-137340 filed Jun. 8, 2009, which is hereby incorporated by reference herein in its entirety.

What is claimed is:

1. A recording apparatus comprising:

a recording head, including a first discharge port array and a second discharge port array in which a plurality of discharge ports for discharging ink is arranged in a predetermined direction, wherein the first discharge port array and a second discharge port array are arranged in the direction crossing the predetermined direction, for recording an image on a recording medium by scanning the recording head to the recording medium in a scan direction crossing the predetermined direction;

a conveyance unit configured to convey the recording medium in a conveyance direction crossing the scan direction;

a controller configured to cause the first and second discharge port arrays to record a plurality of patterns on the recording medium such that a plurality of first patterns are recorded in the scan direction by the same part of the discharge ports of the first discharge port array and each of second patterns to be recorded corresponding to the plurality of first patterns is formed by each of different parts of the discharge ports of the second discharge port array so as to differentiate an extent of an overlap between the first pattern and the second pattern, without conveyance of the recording medium by the conveying unit;

and a correction unit configured to correct an inclination of the first recording position to the scan direction based on the plurality of patterns.

2. The apparatus according to claim 1, wherein the controller causes the first and second discharge port arrays to record the plurality of patterns in one scan of the recording head.

3. The apparatus according to claim 1, wherein the first and second discharge port arrays are mounted on a same chip on the recording head.

4. The apparatus according to claim 1, wherein the recording head has a plurality of discharge port arrays including the first and second discharge port arrays, and wherein the first and second discharge port arrays are most outside discharge port arrays in the moving direction among the plurality of discharge port arrays.

5. The apparatus according to claim 4, wherein the plurality of discharge port arrays is mounted on a same chip on the recording head.

6. The apparatus according to claim 4, wherein the correction unit corrects an inclination of a recording position of each of the plurality of discharge port arrays to the scan direction.

7. The apparatus according to claim 1, wherein the first and second discharge port arrays are displaced in the conveyance direction.

8. The apparatus according to claim 1, further comprising:

an optical sensor for reading a plurality of patterns recorded on the recording medium.

9. A method for adjusting a recording position for recording by a recording head, including a first discharge port array and a second discharge port array in which a plurality of discharge ports for discharging ink is arranged in a predetermined direction, wherein the first discharge port array and a second discharge port array are arranged in the direction crossing the predetermined direction, and wherein the recording is performed by scanning the recording head in a scan direction crossing the predetermined direction and conveyance of a recording medium in a conveyance direction crossing the scan direction, the method comprising:

recording a plurality of patterns on the recording medium such that a plurality of first patterns are recorded in the scan direction by the same part of the discharge ports of the first discharge port array and each of second patterns to be recorded corresponding to the plurality of first patterns is formed by each of different parts of the discharge ports of the second discharge port array so as to differentiate an extent of an overlap between the first pattern and the second pattern, without the conveyance of the recording medium; and correcting an inclination of the first recording position to the scan direction based on the plurality of patterns.

10. The method according to claim 9, wherein the plurality of patterns is recorded in one scan of the recording head.

11. The method according to claim 9, further comprising mounting the first and second discharge port arrays on a same chip on the recording head.

12. The method according to claim 9, wherein the first and second discharge port arrays are displaced in the conveyance direction.

13. The method according to claim 9, further comprising:

reading a plurality of patterns recorded on the recording medium.

* * * * *